US009217605B2

(12) United States Patent
Totoki et al.

(10) Patent No.: US 9,217,605 B2
(45) Date of Patent: Dec. 22, 2015

(54) DRYING FURNACE AND DRYING METHOD USING DRYING FURNACE

(75) Inventors: Noriaki Totoki, Kameyama (JP); Yasuhito Takeuchi, Suzuka (JP)

(73) Assignee: HONDA MOTOR CO., LTD., Tokyo (JP)

( * ) Notice: Subject to any disclaimer, the term of this patent is extended or adjusted under 35 U.S.C. 154(b) by 943 days.

(21) Appl. No.: 13/130,917

(22) PCT Filed: Nov. 13, 2009

(86) PCT No.: PCT/JP2009/006099

§ 371 (c)(1),
(2), (4) Date: May 24, 2011

(87) PCT Pub. No.: WO2010/064367

PCT Pub. Date: Jun. 10, 2010

(65) Prior Publication Data

US 2011/0225841 A1 Sep. 22, 2011

(30) Foreign Application Priority Data

Dec. 3, 2008 (JP) ..... 2008-308909

(51) Int. Cl.

| | |
|---|---|
| ***F26B 5/06*** | (2006.01) |
| ***F26B 21/10*** | (2006.01) |
| ***C25D 13/00*** | (2006.01) |
| ***C25D 13/22*** | (2006.01) |
| ***F26B 15/14*** | (2006.01) |

(Continued)

(52) U.S. Cl.

CPC ..... *F26B 21/10* (2013.01); *C25D 13/00* (2013.01); *C25D 13/22* (2013.01); *F26B 15/14* (2013.01); *B05D 3/0254* (2013.01); *B05D 7/14* (2013.01); *F26B 2210/12* (2013.01)

(58) Field of Classification Search

CPC ..... F26B 2210/12; F26B 3/283; B05D 7/14; B05D 3/0254; B05D 7/572; B05D 3/0209

USPC ..... 34/666, 270

See application file for complete search history.

(56) References Cited

U.S. PATENT DOCUMENTS 4,761,894 A * 8/1988 Hamasaki et al. ..... 34/270
4,771,552 A * 9/1988 Morioka ..... 34/222

(Continued)

FOREIGN PATENT DOCUMENTS

JP 54-61246 5/1979
JP 05-086495 4/1993

(Continued)

*Primary Examiner* — Kenneth Rinehart
*Assistant Examiner* — Jason Lau
(74) *Attorney, Agent, or Firm* — Rankin, Hill & Clark LLP

(57) ABSTRACT

A drying furnace including: a heating portion which heats a coating target having been subjected to electrodeposition coating, wherein (i) the heating portion sets an inner furnace temperature of an upstream of the drying furnace to be lower than a temperature at which moisture in electrodeposition paint boils, (ii) the heating portion sets an inner furnace temperature of a downstream of the drying furnace to be higher than or equal to a glass transition point, (iii) the heating portion locally heats a gap position formed at a member bonding portion of the coating target at the upstream of the drying furnace, and (iv) the heating portion sequentially changes a heated portion from an upper side to a lower side of the coating target when the gap position is locally heated.

4 Claims, 9 Drawing Sheets

(51) Int. Cl.
*B05D 3/02* (2006.01)
*B05D 7/14* (2006.01)

(56) References Cited

U.S. PATENT DOCUMENTS

| | | | | | |
|---|---|---|---|---|---|
| 5,075,132 | A | * | 12/1991 | Ogasawara | 427/557 |
| 5,323,485 | A | * | 6/1994 | Josefsson et al. | 392/417 |
| 5,397,606 | A | * | 3/1995 | Jeffs | 427/542 |
| 5,556,466 | A | * | 9/1996 | Martin et al. | 118/67 |
| 5,657,555 | A | * | 8/1997 | Milojevic et al. | 34/271 |
| 5,661,912 | A | * | 9/1997 | Bhatnagar et al. | 34/270 |
| 5,743,962 | A | * | 4/1998 | Ogasawara et al. | 118/643 |
| 6,062,850 | A | * | 5/2000 | Ino et al. | 432/143 |
| 7,011,869 | B2 | * | 3/2006 | Emch | 427/542 |
| 7,179,358 | B2 | * | 2/2007 | Tominaga et al. | 204/488 |
| 7,200,953 | B2 | * | 4/2007 | Sonner et al. | 34/225 |
| 7,600,329 | B2 | * | 10/2009 | Ortlieb et al. | 34/666 |
| 2002/0090461 | A1 | * | 7/2002 | Ohmoto et al. | 427/402 |
| 2003/0042113 | A1 | * | 3/2003 | Kasagi | 198/465.1 |
| 2004/0237339 | A1 | * | 12/2004 | Sonner et al. | 34/666 |
| 2005/0087183 | A1 | * | 4/2005 | Klobucar et al. | 126/21 A |
| 2008/0268256 | A1 | * | 10/2008 | Nagano et al. | 428/413 |

FOREIGN PATENT DOCUMENTS

| | | |
|---|---|---|
| JP | 11-131292 | 5/1999 |
| JP | 2003-239098 | 8/2003 |

* cited by examiner

DRYING FURNACE AND DRYING METHOD USING DRYING FURNACE

TECHNICAL FIELD

The present invention relates to a drying furnace which dries a coating target such as a vehicle body having been subjected to a process of electrodeposition coating and a drying method using the drying furnace.

Priority is claimed on Japanese Patent Application No. 2008-308909, filed on Dec. 3, 2008, the contents of which are incorporated herein by reference.

BACKGROUND ART

Both currently and in the past, when a vehicle body having been subjected to electrodeposition coating is baked inside a drying furnace, a coating fluid of electrodeposition paint gushes or flows out, in particular, from a gap of a steel sheet laminated portion of a door sash portion and a steel sheet laminated portion of a lower end of a sac-shaped portion of a door, so that there is a problem in that the coating fluid sags down and is cured at an upper surface, a side surface, and the like of a side sill of the vehicle body (hereinafter, referred to as a sagging defect of electrodeposition paint). When this sagging defect of electrodeposition paint occurs, there is a need to grind off a cured portion formed by the coating fluid dropped thereto so that the portion is smoothened together with an electrodeposition coating cured surface of the side sill.

However, since it takes some time for the work of grinding off the portion with the sagging, a problem arises in that waste materials generated by the grinding adhere to the vehicle body again.

For this problem, according to Patent Document 1 below, there is proposed a technology in which a heater and a shower device are provided in a transfer path for transferring a vehicle body having been subjected to electrodeposition coating to a drying furnace. The heater uses hot air to locally heat a surface of a vehicle body, such as a roof, a filler portion, or a locker portion having a small gap opening into which a coating fluid of electrodeposition paint may intrude, so as to boil the coating fluid. Accordingly, the fluidity of the coating fluid intruding into the gap increases and the coating fluid thermally expands, whereby the intruding coating fluid flows out from the gap. Subsequently, the coating fluid flowing out therefrom is cleaned and removed by shower water of the shower device.

PATENT DOCUMENTS

[PATENT DOCUMENT 1] Japanese Unexamined Patent Application, First Publication No. H5-086495

DISCLOSURE OF THE INVENTION

Problem that the Invention is to Solve

However, in the technology of using the heater and the shower device, the concentration of the coating fluid of electrodeposition paint bled from the gap opened to the upper portion of the vehicle body is reduced by the shower water, but a problem arises in that the coating fluid intrudes into the gap opened to the lower portion of the vehicle body again. Further, since some coating fluid of the electrodeposition paint remains in the gap without flowing out from the gap due to surface tension even when the portion is heated by the heater, the concentration of the coating fluid increases. Then, there is a concern the sagging defect of electrodeposition paint will result from the coating fluid flowing out again due to the heating of the electrodeposition drying furnace.

The present invention is made in view of such circumstances, and an object of the present invention is to provide a drying furnace capable of preventing a sagging defect of a coating fluid of electrodeposition paint even when the coating fluid of the electrodeposition paint intrudes into a gap of a coating target and a drying method using the drying furnace.

Means for Solving the Problem

The present invention adopts the following configuration in order to attain the object solving the above-described problems. That is, (1) A drying furnace of the present invention includes: a heating portion which heats a coating target having been subjected to electrodeposition coating, wherein (i) the heating portion sets an inner furnace temperature of an upstream of the drying furnace to be lower than a temperature at which moisture in electrodeposition paint boils, (ii) the heating portion sets an inner furnace temperature of a downstream of the drying furnace to be higher than or equal to a glass transition point, (iii) the heating portion locally heats a gap position formed at a member bonding portion of the coating target at the upstream of the drying furnace, and (iv) the heating portion sequentially changes a heated portion from an upper side to a lower side of the coating target when the gap position is locally heated.

According to the drying furnace described in (1) above, since the gap portion of the member bonding portion present in the coating target is locally heated by the heating portion at the upstream of the drying furnace, the coating fluid of the electrodeposition paint evaporates without the boiling the moisture thereof. On the other hand, since the heating is performed at the temperature higher than or equal to the glass transition point at the downstream of the drying furnace, the coating target may be dyed by the coating fluid of the electrodeposition paint. Accordingly, since the amount of the coating fluid of the electrodeposition paint may be reduced without causing the flying thereof due to the boiling thereof, it is possible to make the sagging thereof difficult to be generated. Further, since the heated portion is sequentially changed from the upper side of the coating target to the lower side thereof, it is possible to gradually guide the coating fluid of the electrodeposition paint staying at the gap portion downward. Accordingly, it is possible to prevent the coating fluid of the electrodeposition paint from sagging to the lower member.

(2) The drying furnace described in (1) above may be a mountain-shaped furnace which gradually increases in height from the upstream to the downstream so that a coating surface of the coating target is obliquely inclined.

In the case of (2) above, most of the coating fluid of the electrodeposition paint is heated at the downstream of the drying furnace, but the coating fluid slightly left in the gap position of the coating target may be dropped from the rear portion of the inclined coating target to the surface of the coating target which is not dried yet so as to dye that portion. Accordingly, even when the coating fluid is not dried and left up to the downstream of the drying furnace, it is possible to prevent an electrodeposition paint sagging defect.

(3) In the drying furnace described in (1) above, the heating portion may locally heat a bottom portion of the coating target at the downstream of the drying furnace.

In the case of (3) above, since it is possible to ensure a more time for drying the bottom portion which is difficult to be dried, it is possible to reliably dry the bottom portion.

(4) In the drying furnace described in (1) above, the coating target may be a vehicle body.

In the case of (4) above, in the drying after the electrodeposition coating of the vehicle body, since it is not necessary to perform a work of correcting a defective portion, it is possible to shorten the work time.

(5) In the drying furnace described in (4) above, an upper portion of the gap position may be a door sash and a lower portion of the gap position may be a door skin.

In the case of (5) above, since it is possible to reliably dry the member where much coating liquid of electrodeposition paint is easy to remain as in the door sash including a channel material or a door skin having a reinforcement plate, it is possible to improve the appearance quality.

(6) In the drying furnace described in (3) above, the bottom portion may be a side sill of the vehicle body.

In the case of (6) above, since it is possible to satisfactorily dry the side sill of the vehicle body, the drying time may be matched with the drying time for the other members of the vehicle body.

(7) In the drying furnace described in (1) above, the heating portion may include a slit-shaped hot air blowing opening.

In the case of (7) above, since it is possible to uniformly heat only the local portion, it is possible to efficiently prevent the sagging of the coating fluid of the electrodeposition paint.

(8) A drying method using a drying furnace of the present invention dries a coating target having been subjected to electrodeposition coating, the drying method including: a first step of setting an inner furnace temperature of an upstream of the drying furnace to be lower than a temperature at which moisture in electrodeposition paint boils; and a second step of locally heating the coating target at the upstream while an inner furnace temperature of a downstream of the drying furnace is set to be higher than or equal to a glass transition point, wherein in the second step, a heated portion is sequentially changed from an upper side to a lower side of the coating target when the coating target is locally heated.

According to the drying method of a drying furnace described in (8) above, since the gap portion of the member bonding portion present in the coating target is locally heated by the heating portion at the upstream of the drying furnace, the coating fluid of the electrodeposition paint evaporates without the boiling the moisture thereof. On the other hand, since the heating is performed at the temperature higher than or equal to the glass transition point at the downstream of the drying furnace, the coating target may be dyed by the coating fluid of the electrodeposition paint. Accordingly, since the amount of the coating fluid of the electrodeposition paint may be reduced without causing the flying thereof due to the boiling thereof, it is possible to make the sagging thereof difficult to be generated. Further, since the heated portion is sequentially changed from the upper side of the coating target to the lower side thereof, it is possible to gradually guide the coating fluid of the electrodeposition paint staying at the gap portion downward. Accordingly, it is possible to prevent the coating fluid of the electrodeposition paint from sagging to the lower member.

Effects of the Invention

According to the drying furnace and the drying method using the drying furnace of the present invention, even when a coating fluid of electrodeposition paint intrudes into a gap portion of a coating target, a sagging defect caused by the coating fluid of the electrodeposition paint may be prevented.

DESCRIPTION OF EMBODIMENTS

A drying furnace and a drying method using the drying furnace according to an embodiment of the invention will be described below by referring to FIGS. 1 to 11.

The drying furnace of the embodiment dries a coating fluid of electrodeposition paint using hot air at the rear stage of electrodeposition coating in which a vehicle body (a white body) of a vehicle is a work.

Figure 1:
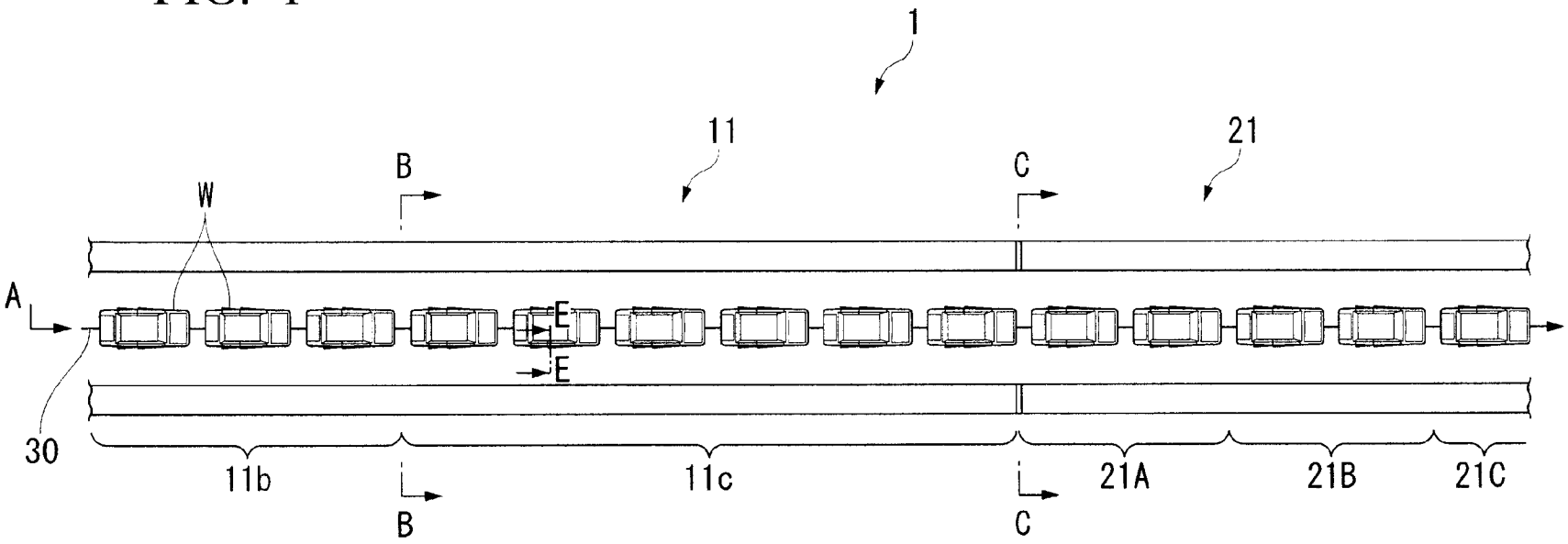
FIG. 1 is a plan cross-sectional view schematically illustrating a drying furnace according to an embodiment of the present invention.
Figure 2:
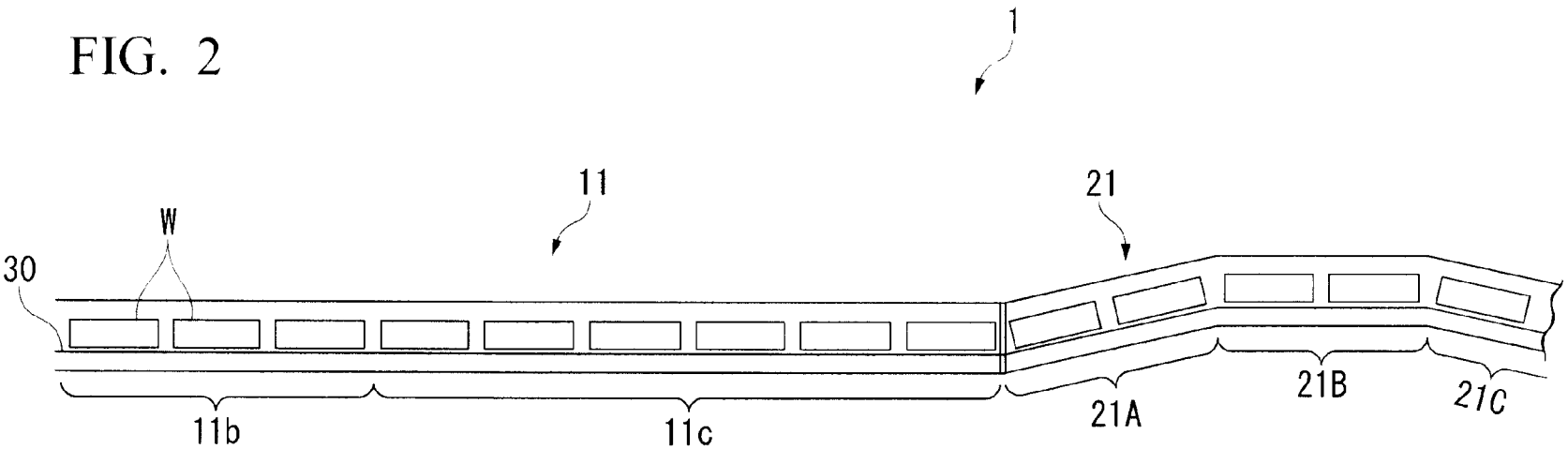
FIG. 2 is a longitudinal sectional view schematically illustrating the drying furnace according to the embodiment.

FIG. 1 is a schematic plan cross-sectional view illustrating the drying furnace. FIG. 2 is a schematic longitudinal sectional view illustrating the drying furnace. As shown in FIGS. 1 and 2, a drying furnace 1 receives a vehicle body W on a carrier 31 supporting a vehicle body having been subjected to the electrodeposition coating in the front-stage process from each transfer conveyor 30.

The drying furnace 1 includes a pre-heating furnace 11 which performs preliminary drying at the upstream and a mountain-shaped main drying furnace 21 which performs main drying at the downstream. The drying furnace 1 dries the coating fluid of the electrodeposition paint attached to the vehicle body W on the carrier 31 supporting the vehicle body transferred by the transfer conveyor 30 and sequentially transferred after the electrodeposition coating of the front stage at the pre-heating furnace 11 and the main drying furnace 21, and moves the vehicle body to the next stage process. Furthermore, a door D is attached to the vehicle body W.

The pre-heating furnace 11 includes a front-stage sash pre-heating portion 11*b* and a rear-stage door skin (door outer panel) pre-heating portion 11*c*. The main drying furnace 21 includes an entrance inclination portion 21A which gradually increases in height from the upstream to the downstream and dries the vehicle body W while the vehicle body is inclined upward; a horizontal portion 21B which dries the vehicle body W while the vehicle body is horizontally transferred;

and an exit inclination portion 21C which gradually decreases in height from the upstream to the downstream and dries the vehicle body W while the vehicle body is inclined downward. The entrance inclination portion 21A, the horizontal portion 21B, and the exit inclination portion 21C constitute the mountain-shaped main drying furnace 21 in which the horizontal portion 21B is more easily maintained at a high temperature.

Figure 3:
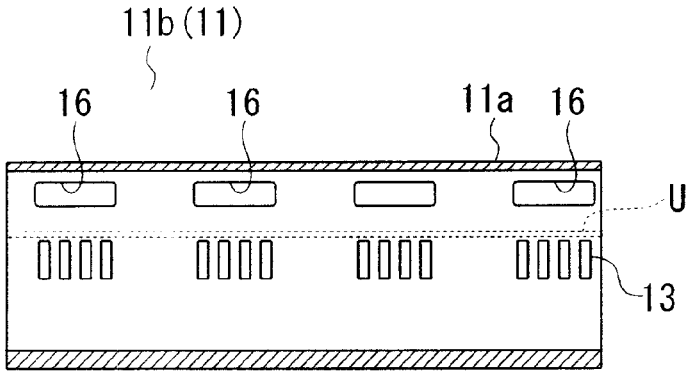
FIG. 3 is a longitudinal sectional view illustrating a sash pre-heating portion of a pre-heating furnace according to the embodiment.
Figure 4:
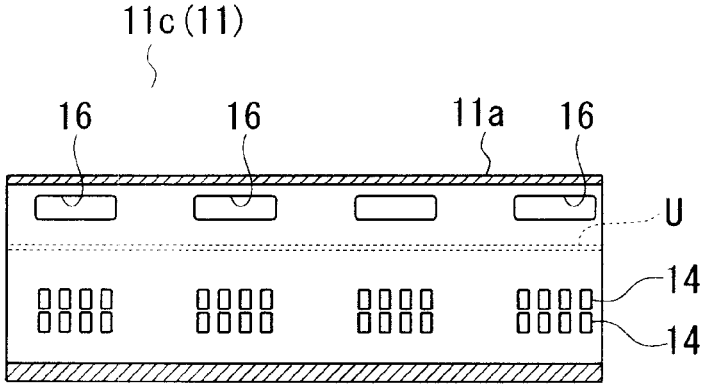
FIG. 4 is a longitudinal sectional view illustrating a door skin pre-heating portion of the pre-heating furnace according to the embodiment.
Figure 5:
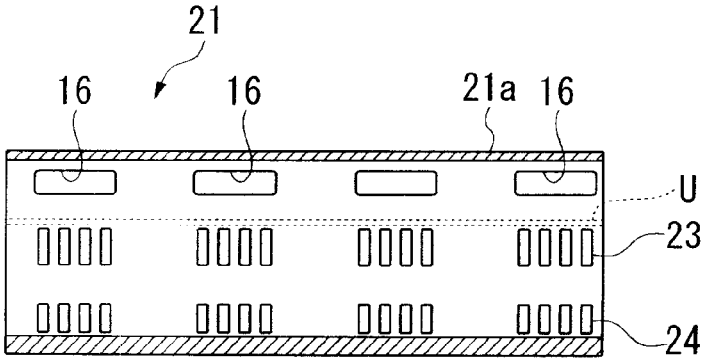
FIG. 5 is a longitudinal sectional view illustrating a main drying furnace according to the embodiment.

FIG. 3 illustrates an inner wall 12*a* (including an inner wall 15*a* to be described later) of the sash pre-heating portion 11*b* of the pre-heating furnace 11. FIG. 4 illustrates the inner wall 12*a* (including the inner wall 15*a* to be described later) of the door skin pre-heating portion 11*c* of the pre-heating furnace 11. FIG. 5 illustrates an inner wall 22*a* (including an inner wall 25*a* to be described later) of the main drying furnace 21.

As shown in FIGS. 3 to 5, each of the inner walls 12*a* and 22*a* is provided with a plurality of hot air blowing openings 16 which is formed at the upper end portion thereof so as to be elongated in the transverse direction. The hot air blowing openings 16 are provided with a predetermined interval therebetween, and blow hot air supplied into the pre-heating furnace 11 and the main drying furnace 21.

In the inner wall 12*a* of the sash pre-heating portion 11*b* shown in FIG. 3, a plurality of pairs of four slit-shaped hot air blowing openings 13 is provided at the upper center portion in the vertical direction so as to be elongated in the vertical direction with a predetermined interval therebetween.

In the inner wall 12*a* of the door skin pre-heating portion 11*c* shown in FIG. 4, a plurality of pairs of four slit-shaped hot air blowing openings 14 is provided at the lower center portion in the vertical direction so as to be elongated in the vertical direction with a predetermined interval therebetween and to be provided at the upper and lower two stages. Here, each hot air blowing opening 14 faces upward.

In the inner wall 22*a* of the main drying furnace 21 shown in FIG. 5, a plurality of pairs of four slit-shaped first hot air blowing openings 23 is provided at the upper center portion in the vertical direction so as to be elongated in the vertical direction with a predetermined interval therebetween. Further, a plurality of pairs of four slit-shaped second hot air blowing openings 24 is provided at the lower center portion in the vertical direction so as to be elongated in the vertical direction with a predetermined interval therebetween.

Figure 6:
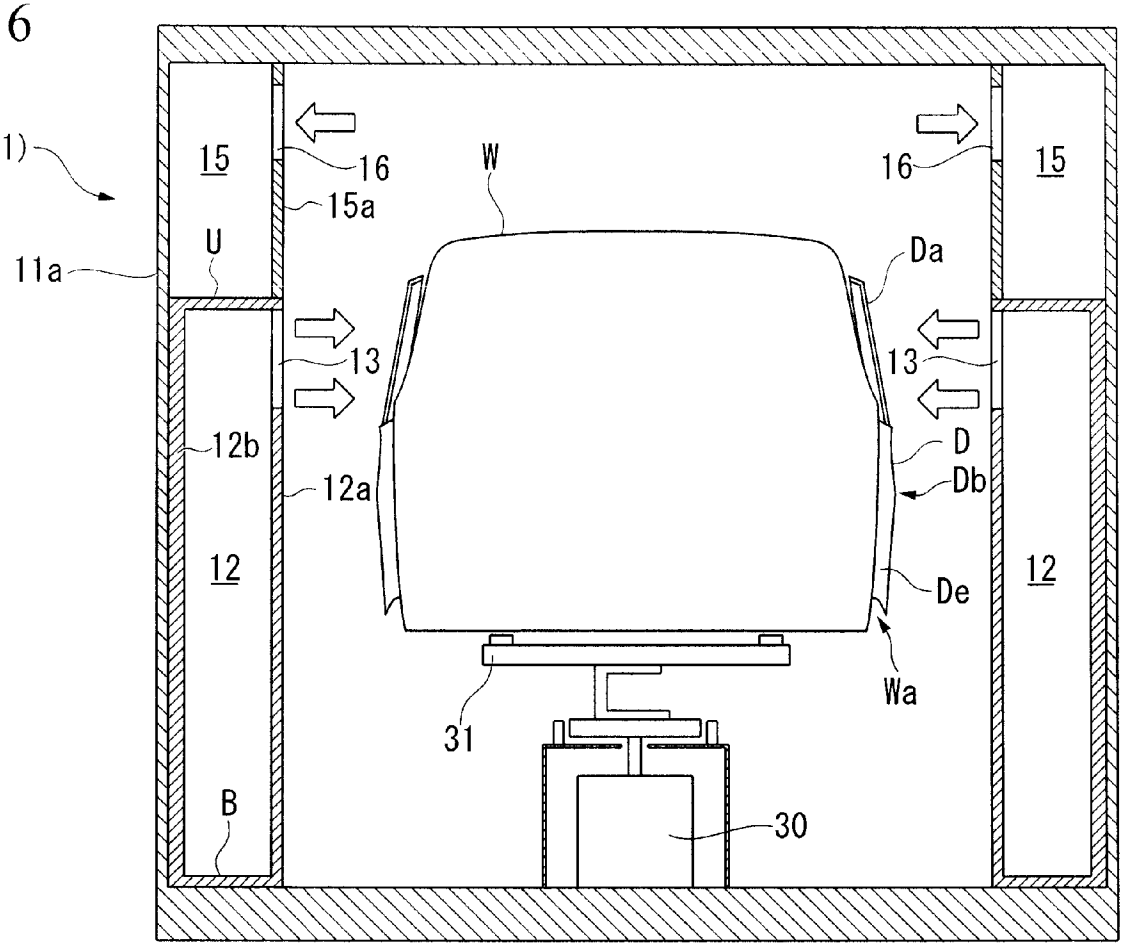
FIG. 6 is a diagram taken along the arrow A of FIG. 1.
Figure 7:
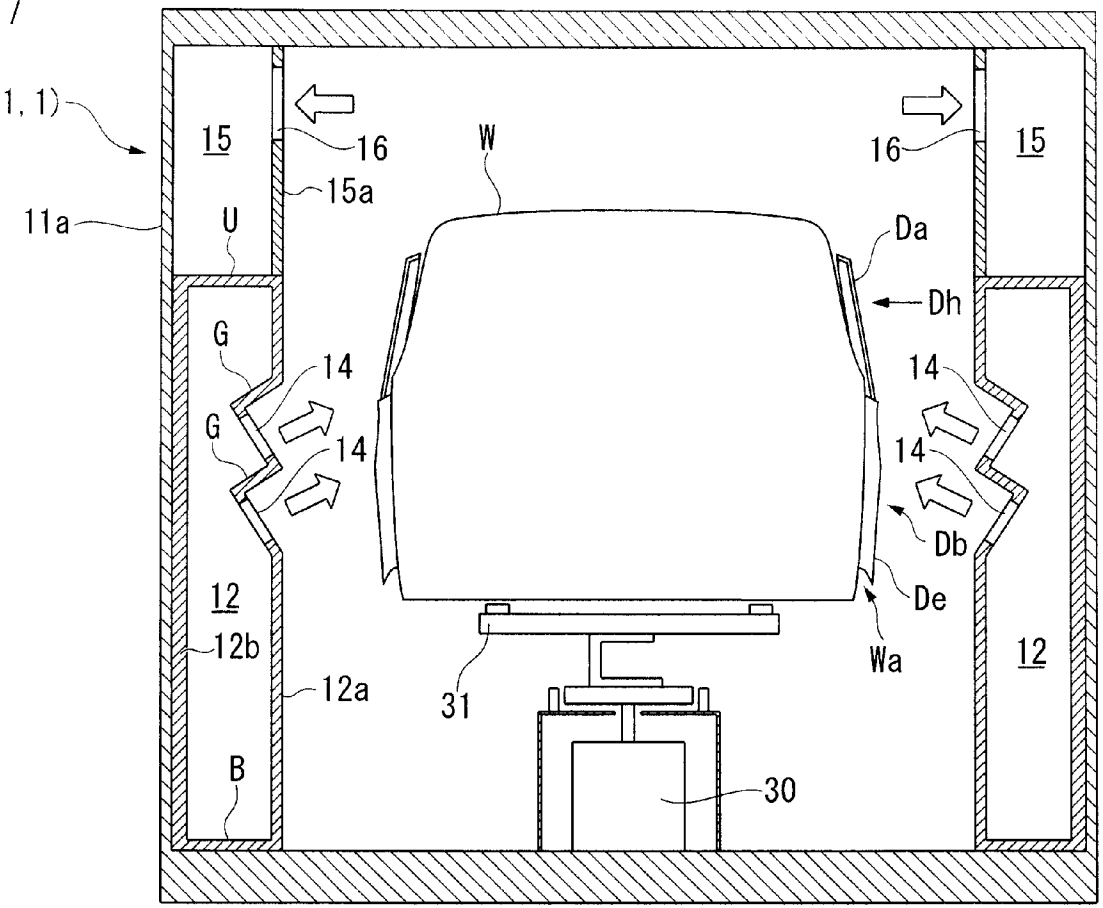
FIG. 7 is a cross-sectional view taken along the line B-B of FIG. 1.
Figure 8:
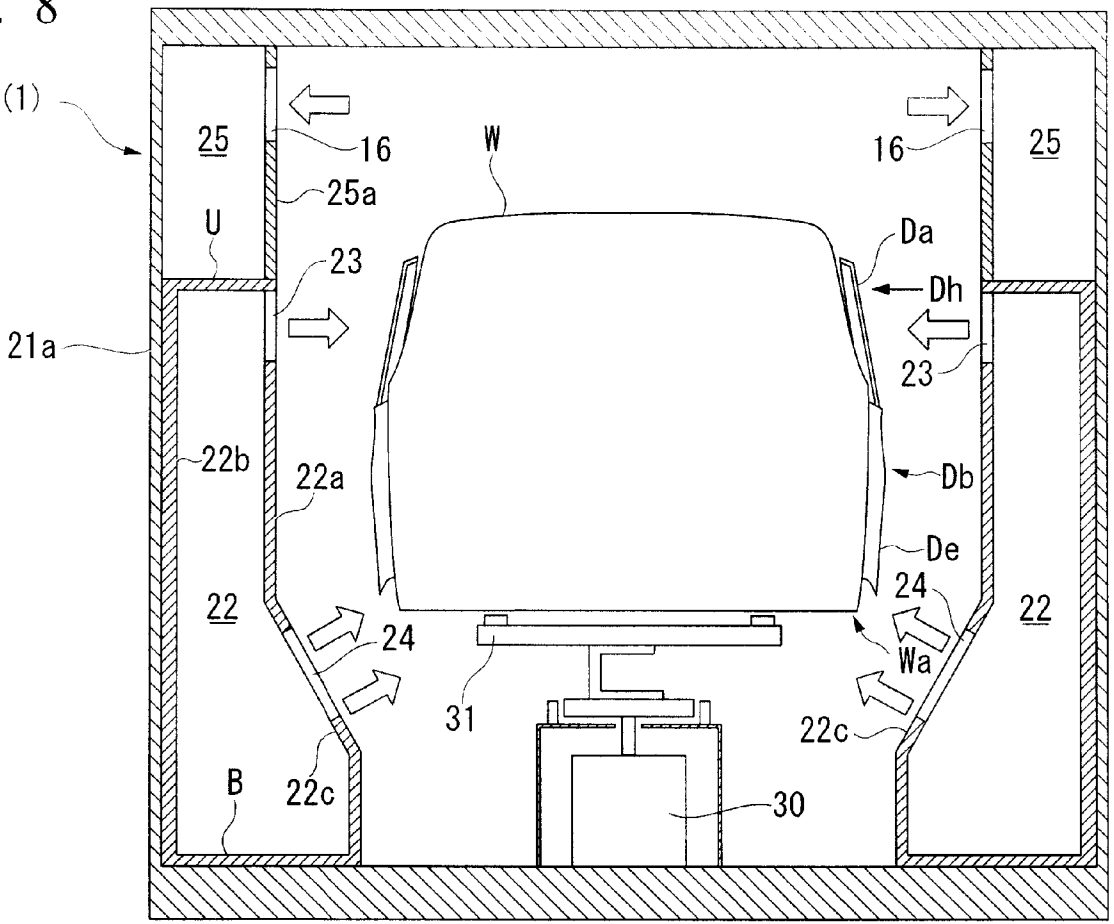
FIG. 8 is a cross-sectional view taken along the line C-C of FIG. 1.
Figure 9:
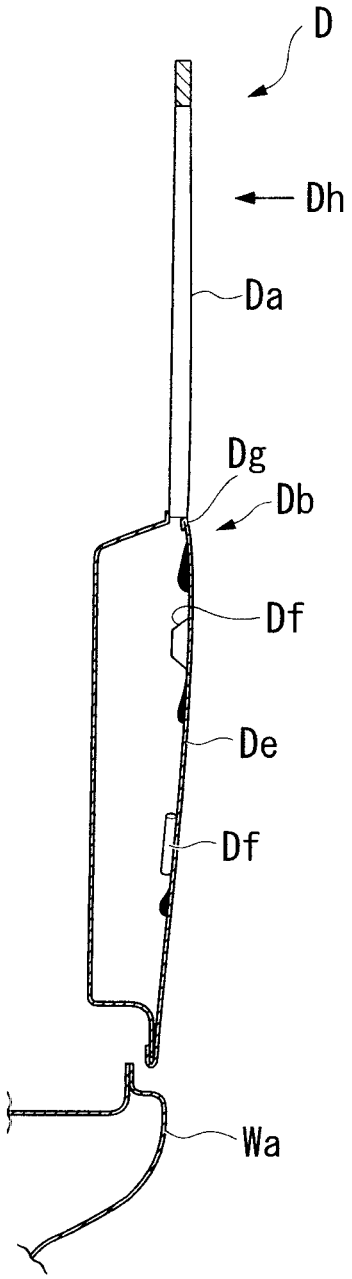
FIG. 9 is a cross-sectional view taken along the line E-E of FIG. 1.
Figure 10:
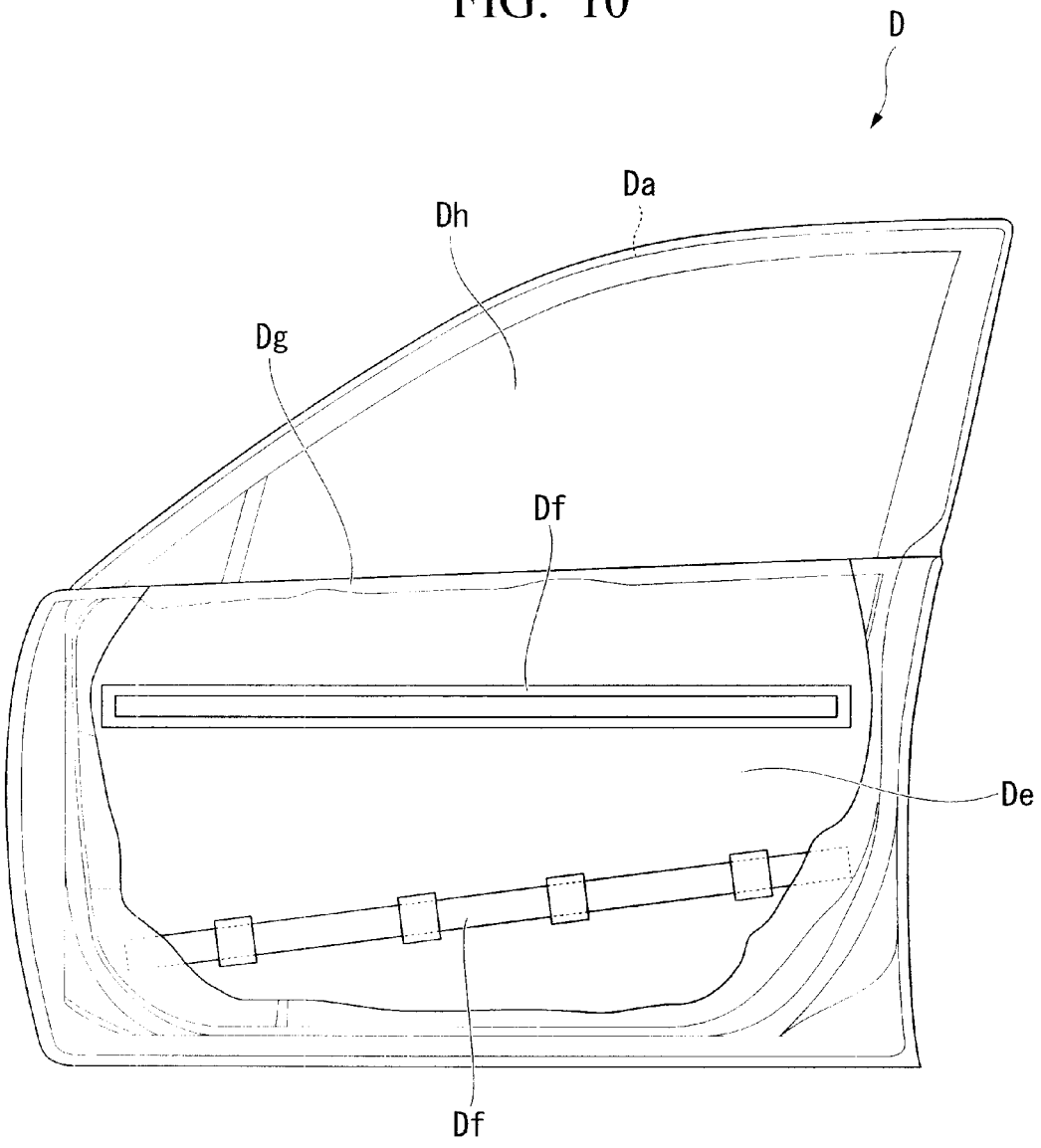
FIG. 10 is a partially cutaway view when a door is seen from an interior of a vehicle.

FIGS. 6 to 8 are cross-sectional views illustrating the pre-heating furnace 11 and the main drying furnace 21.

Specifically, as shown in FIGS. 6 and 7, the pre-heating furnace 11 includes a furnace outer wall 11*a* having a square cross-sectional shape. A hot air supply path 12 is formed at both inner sides spaced by a predetermined gap from the side wall of the furnace outer wall 11*a* so as to surround a lower half portion of both sides of a transfer space of the vehicle body W. The hot air supply path 12 is defined by the inner wall 12*a*, the outer wall 12*b*, the top wall U, and the bottom wall B. Further, a hot air discharge path 15 is formed above the hot air supply path 12. The hot air discharge path 15 is defined by the inner wall 15*a* continuous to the upper portion of the inner wall 12*a* and the furnace outer wall 11*a*. Here, the pre-heating furnace 11 is set so that the inner furnace temperature is normally 80° C.

In the sash pre-heating portion 11*b* of the pre-heating furnace 11 shown in FIG. 6, the hot air blowing opening 13 is provided at the upper portion of the inner wall 12*a* of the hot air supply path 12. Then, the hot air discharge opening 16 is provided at the upper portion of the inner wall 15*a* of the hot air discharge path 15.

Here, the transfer conveyor 30 is provided between both inner walls 12*a*. Then, the vehicle body W is placed on the carrier 31 supporting the vehicle body transferred by the transfer conveyor 30 (the same applies to FIGS. 7 and 8). In the vehicle body W, the door D is slightly opened by a jig (not shown). Then, the hot air blowing opening 13 is opened to face the sash portion Da of the door D. Further, a hot air discharge opening 16 is opened so that hot air is discharged into the furnace in the horizontal direction above the vehicle body W. Furthermore, Db denotes the door skin portion, De denotes the outer skin, and Wa denotes a side sill.

In the door skin pre-heating portion 11*c* of the pre-heating furnace 11 shown in FIG. 7, the hot air blowing opening 14 is provided at the upper center portion in the vertical direction of the hot air supply path 12 of the inner wall 12*a*. Then, the hot air discharge opening 16 is provided at the upper portion of the inner wall 15*a* of the hot air discharge path 15.

Here, the hot air blowing opening 14 is opened obliquely upward. Then, the hot air blowing opening 14 is provided to face a structure member such as a stiffener Df bonded to an inner surface of an outer skin De of the door skin portion Db of the door D attached to the vehicle body W or an outer skin double-fold portion Dg of a lower end of a door glass opening portion Dh as an upper end of the door skin portion Db (refer to FIGS. 9 and 10). A guide portion G is formed at the inner wall 12*a* above the hot air blowing opening 14 so as to be inclined outward and downward.

Furthermore, the hot air discharge opening 16 is opened so that hot air is charged into the furnace in the horizontal direction above the vehicle body W as in the sash pre-heating portion 11*b*. Furthermore, in FIG. 9, the portion painted black indicates the coating fluid of the electrodeposition paint.

Further, as shown in FIG. 8, the main drying furnace 21 also includes a furnace outer wall 21*a* having a square cross-sectional shape.

A hot air supply path 22 is formed at both inner sides spaced by a predetermined gap from the side wall of the furnace outer wall 21*a* so as to surround a lower half portion of both sides of a transfer space of the vehicle body W. The hot air supply path 22 is defined by the inner wall 22*a*, the outer wall 22*b*, the top wall U, and the bottom wall B. Further, a hot air discharge path 25 is formed above the hot air supply path 22. The hot air discharge path 25 is defined by the inner wall 25*a* continuous to the upper portion of the inner wall 22*a* and the furnace outer wall 21*a*. A first hot air blowing opening 23 is provided at the upper portion of the inner wall 22*a* of the hot air supply path 22. Then, a second hot air blowing opening 24 is provided at the lower portion of the inner wall 22*a*. Further, the hot air discharge opening 16 is provided at the upper portion of the inner wall 25*a* of the hot air discharge path 25.

Specifically, in the hot air supply path 22, the widths of the inner wall 22*a* and the outer wall 22*b* of the lower portion are wider than those of the upper portion. That is, an inclination portion 22*c* is formed at the lower portion of the inner wall 22*a* so as to be inclined, whereby both inner walls 22*a* become closer to each other as it goes to the lower portion thereof. Then, the inclination portion 22*c* is provided with a second hot air blowing opening 24 which faces obliquely upward so that it faces the side sill Wa of the vehicle body W transferred by the carrier 31 supporting the transferred vehicle body. Further, the upper portion of the inner wall 22*a* is provided with a first hot air blowing opening 23 which faces the horizontal direction so that it faces the door glass opening portion Dh formed in the door D attached to the vehicle body. W.

Here, the hot air supply paths 12 and 22 and the hot air discharge paths 15 and 25 of the pre-heating furnace 11 and the main drying furnace 21 are separately provided. Further, the hot air supply paths 12 and 22 are separately connected to a heating device (not shown).

Next, an operation of the present invention will be described.

When the vehicle body W having been subjected to the electrodeposition coating at the front-stage process is transferred to the pre-heating furnace 11 of the drying furnace 1, the sash portion Da is first heated by hot air of 80° C. blowing from the hot air blowing opening 13 of the sash pre-heating portion 11*b* as shown in FIG. 6. Accordingly, moisture in the coating fluid of the electrodeposition paint coated and attached to the surface of the sash portion Da evaporates in a non-boiled state, so that the surface thereof is dried. Further, even in the coating fluid of the electrodeposition paint intruding into a gap between plural steel sheets bent and laminated in order to form the sash portion Da, the moisture thereof evaporates in a non-boiled state, so that the amount of the moisture is reduced.

Next, when the vehicle body W is transferred to the door skin pre-heating portion 11*c* of the pre-heating furnace 11 as shown in FIG. 7, moisture in the electrodeposition paint coated and attached to the surface of the door skin portion Db evaporates in a non-boiled state by hot air of 80° C. blowing out from the hot air blowing opening 14 of the door skin pre-heating portion 11*c*, so that the surface thereof is dried. Further, even in the coating fluid of the electrodeposition paint intruding into a gap between the inner surface of the outer skin De of the door D and the stiffner Df and a gap between plural steel sheets forming the outer skin double-fold portion Dg of the lower end of the door glass opening portion Dh as the upper end of the door skin portion Db, moisture thereof evaporates in a non-boiled state, so that the amount of moisture is reduced.

Next, as shown in FIG. 8, the vehicle body W is transferred to the main drying furnace 21 in which the ambient temperature inside the furnace is set to higher than or equal to 170° C. and lower than or equal to 180° C. by the hot air from the first hot air blowing opening 23 and the second hot air blowing opening 24.

As shown in FIG. 2, the vehicle body W is first transferred to the entrance inclination portion 21A having a comparatively low temperature in the main drying furnace 21. In the entrance inclination portion 21A, the vehicle body W is transferred while the rear portion thereof is inclined downward. For this reason, there is a concern that the coating fluid of the electrodeposition paint sags down to be dropped from a gap between the steel sheets of the sash portion Da of the door D, a gap between the outer skin De of the door D and the structure member bonded thereto, or a gap between the steel sheets of the outer skin double-fold portion Dg of the lower end of the door glass opening portion Dh as the upper end of the outer skin De (refer to FIG. 9). However, since the moisture evaporates, the amount of the coating fluid of the electrodeposition paint between the steel sheets is small. Even when the moisture is left, the electrodeposition paint sags down from the gap in the entrance inclination portion 21A of the main drying furnace 21. Further, at this time, the side sill Wa of the vehicle body W is not dried and baked yet. Accordingly, even when the coating fluid of the electrodeposition paint sags down, no problem arises since the portion which is not dried is dyed by the coating fluid.

Next, the vehicle body W is transferred to the horizontal portion 21B having a high temperature and located at the upper portion of the main drying furnace 21, and is baked by hot air while the ambient temperature inside the furnace is higher than or equal to 170° C. and lower than or equal to 180° C. At this time, the second hot air blowing opening 24 blows hot air toward the side sill Wa where the temperature is difficult to increase due to the large number of laminated steel sheets in the portion of the vehicle body W. For this reason, the temperature of the vehicle body W uniformly increases as a whole, and the temperature of electrodeposition paint coated on the vehicle body W reaches the glass transition point. At this time, the electrodeposition coating film causes an abrupt reduction in viscosity, and a leveling action occurs due to the sagging, thereby forming a clean coating film. Then, after the coating film is formed, the coating fluid of the electrodeposition paint does not sag down to the side sill Wa due to thermal expansion from the sash portion Da of the door D, the structure member bonded to the outer skin De of the door D, or the outer skin double-fold portion Dg of the lower end of the door glass opening portion Dh, whereby an electrodeposition sagging defect does not occur.

Then, the vehicle body W is transferred to the next-stage process through the exit inclination portion 21C of the main drying furnace 21.

According to the above-described embodiment, in the pre-heating furnace 11 of the upstream of the drying furnace, the gap portion of the member bonding portion such as the door D present in the vehicle body W is locally heated at 80° C. by the heating portion, so that the moisture of the coating fluid of the electrodeposition paint evaporates without boiling the moisture. On the other hand, in the main drying furnace 21, since the heating is performed at the temperature higher than or equal to 170° C. and lower than or equal to 180° C. which is higher than or equal to the glass transition temperature, the vehicle body W may be dyed by the coating fluid of the electrodeposition paint. Accordingly, since the amount the coating fluid of the electrodeposition paint may be reduced without causing the flying of the coating fluid due to the boiling thereof, the sagging thereof is difficult to be generated.

Further, in order to heat the vehicle body W, the sash portion Da of the door D as the upper side of the vehicle body W is first heated by the sash pre-heating portion 11*b* as shown in FIG. 6. Next, the door skin portion Db of the door D as the lower side of the vehicle body W is heated by the door skin pre-heating portion 11*c* as shown in FIG. 7. Likewise, since the heated portion is sequentially changed, the coating fluid of the electrodeposition paint staying at the gap portion may be gradually guided downward. Accordingly, the coating fluid of the electrodeposition paint may be prevented from sagging to the lower member.

Then, the main drying furnace 21 gradually increases in height from the entrance inclination portion 21A to the horizontal portion 21C. Here, the coating fluid of the electrodeposition paint heated at the pre-heating furnace 11, but slightly remaining at the gap position may be dropped from the rear portion of the inclined vehicle body W to the surface of the vehicle body W which is not dried yet, for example, the side sill Wa to dye that portion. For this reason, even when the sagging of the coating fluid occurs, an electrodeposition paint sagging defect does not occur.

Furthermore, the main drying furnace 21 ensures a more heating amount compared with other members since the side sill Wa which is difficult to be dried is dried by hot air from the second hot air blowing opening 24. Accordingly, it is possible to reliably dry the side sill Wa which has many components for reinforcement and in which the coating fluid of the electrodeposition coating is easy to remain. Therefore, since it is not necessary to perform a work of correcting a defective portion, it is possible to shorten the work time, and to improve the appearance quality.

Further, likewise, since the side sill Wa which is difficult to be dried is intensively dried, the drying time may be matched with the drying time for the other portions. For this reason, the work time may be shortened.

Then, the drying is performed in a manner such that the coating fluid of the electrodeposition paint is heated and extruded by the wind pressure of hot air. At this time, since the heat receiving area is widened as the coating fluid of the electrodeposition paint extruded by the wind pressure spreads on the surface of the member of the vehicle body W, the drying of the coating fluid may be prompted.

Figure 11:
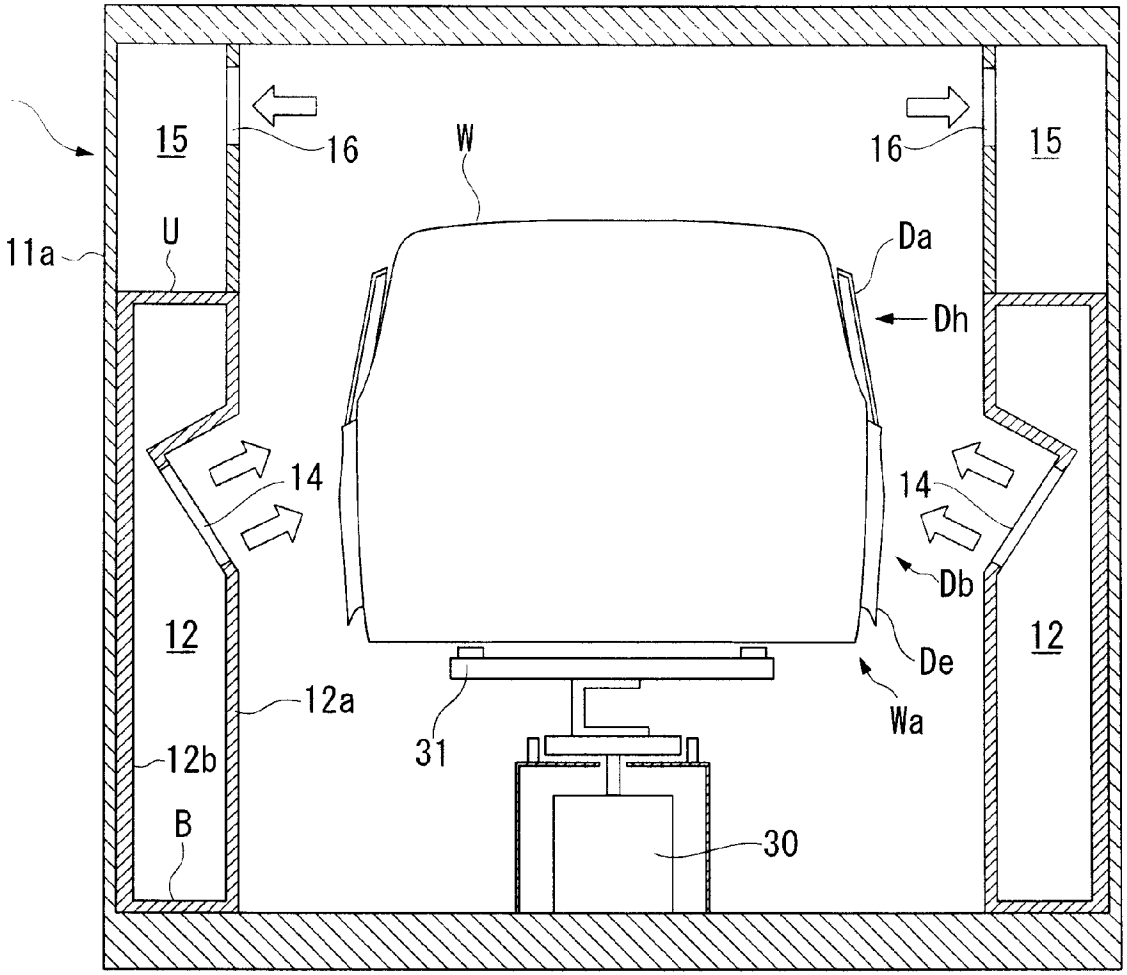
FIG. 11 is a cross-sectional view illustrating another embodiment of the present invention and corresponding to FIG. 8.

Furthermore, the present invention is not limited to the above-described embodiment. For example, in FIG. 7, the hot air blowing opening 14 is formed as another hot air blowing opening 14 facing the stiffener Df of the inner surface of the outer skin De of the door D and the vicinity of the door glass opening portion Dh of the upper end of the door skin portion Db. However, as shown in FIG. 11, if the hot air may be supplied to all of those members, the hot air may be concentrated at one slit-shaped hot air blowing opening 14. Here, since the other configuration of FIG. 11 is the same as that of FIG. 8, the same reference numerals are given to the same components, and the description thereof is omitted.

Here, a case has been described in which the hot air supply paths 12 and 22 and the hot air discharge paths 15 and 25 of the pre-heating furnace 11 and the main drying furnace 21 are separately provided and the hot air supply paths 12 and 22 are separately connected to a heating device (not shown). However, the hot air supply path 12 of the pre-heating furnace 11 may be connected to the hot air discharge path 25 of the main drying furnace 21. Further, the heating devices of the pre-heating furnace 11 and the main drying furnace 21 may be commonly used.

The heating temperature of the pre-heating furnace 11 is not limited to 80° C. as long as the temperature prompt the evaporating and does not prompt boiling. Further, the heating temperature of the main drying furnace 21 is not limited to be higher than or equal to 170° C. and lower than or equal to 180° C. as long as the temperature is higher than or equal to the glass transition point.

INDUSTRIAL APPLICABILITY

According to the drying furnace and the drying method using the drying furnace of the present invention, even when a coating fluid of electrodeposition paint intrudes into a gap of a coating target, a sagging defect caused by the coating fluid of the electrodeposition paint may be prevented.

DESCRIPTION OF REFERENCE NUMERALS AND SIGNS

1: DRYING FURNACE
11: PRE-HEATING FURNACE (UPSTREAM)
13: HOT AIR BLOWING OPENING (HEATING PORTION)
14: HOT AIR BLOWING OPENING (HEATING PORTION)
21: MAIN DRYING FURNACE (DOWNSTREAM)
23: FIRST HOT AIR BLOWING OPENING (HEATING PORTION)
24: SECOND HOT AIR BLOWING OPENING (HEATING PORTION)
Da: SASH PORTION (DOOR SASH)
Db: DOOR SKIN PORTION (DOOR SKIN)
Wa: SIDE SILL (BOTTOM PORTION)
W: VEHICLE BODY (COATING TARGET)

The invention claimed is:

1. A drying furnace drying a vehicle body of a vehicle having been subjected to electrodeposition coating, comprising:

a pre-heating furnace which sets an inner furnace temperature of an upstream of the drying furnace to be lower than a temperature at which moisture in electrodeposition paint boils, the pre-heating furnace comprising:

a sash pre-heating portion having a first heating portion that locally heats a gap position formed between plural steel sheets of a sash portion at an upper portion of the vehicle body of the vehicle, and a door skin pre-heating portion having a second heating portion that locally heats a gap position formed between plural steel sheets of a door skin portion at a lower portion of the vehicle body of the vehicle, the door skin pre-heating portion being provided downstream from the sash pre-heating portion, a main drying furnace which is formed in a mountain-shape so that an inner furnace temperature of a downstream of the drying furnace becomes higher than or equal to a glass transition point, the main drying furnace comprising an entrance inclination portion which gradually increases in height from the upstream to the downstream, and a horizontal portion which is positioned downstream of the entrance inclination portion, the horizontal portion having a third heating portion that locally heats a side sill at a bottom portion of the vehicle body of the vehicle, wherein the pre-heating furnace and the main drying furnace include a furnace outer wall having a square cross-sectional shape, a hot air supply path is formed at both inner sides spaced by a predetermined gap from a side wall of the furnace outer wall, the first heating portion, the second heating portion, and the third heating portion are provided at a right inner wall and a left inner wall which form the hot air supply path, the right inner wall and the left inner wall include lower portions in which the third heating portion is formed, the lower portions have inclination portions, and the inclination portions extend inward so that the lower portions of the right inner wall and the left inner wall are closer together than other portions of the right inner wall and the left inner wall, the first heating portion, the second heating portion, and the third heating portion are hot air blowing openings opened on the right inner wall and the left inner wall, and elongated in the vertical direction, and the first heating portion, the second heating portion, and the third heating portion are configured to heat the vehicle body from the upper portion of the vehicle body towards the bottom portion of the vehicle body in a sequence.

2. The drying furnace according to claim 1, wherein the hot air blowing openings are formed in slit-shapes.

3. The drying furnace according to claim 2, wherein the second heating portion is provided to open obliquely upward to face a structure member at least one of: a stiffener bonded to an inner surface of an outer skin of the door skin portion of the door attached to the vehicle body; and an outer skin double-fold portion of a lower end of a door glass opening portion as an upper end of the door skin portion.

4. The drying furnace according to claim 2, wherein a plurality of groups of the hot air blowing openings are formed at the right inner wall and the left inner wall with a predetermined interval between each group, and each group of the hot air blowing openings includes a plurality of hot air blowing openings.

* * * * *